US009839861B1

(12) United States Patent
Ritz

(10) Patent No.: US 9,839,861 B1
(45) Date of Patent: Dec. 12, 2017

(54) SWIRL CONFETTI LAUNCHER

(71) Applicant: Roneé Holmes, Palm Harbor, FL (US)

(72) Inventor: Terry Lee Ritz, Las Vegas, NV (US)

(73) Assignee: Roneé Holmes, Palm Harbor, FL (US)

( * ) Notice: Subject to any disclaimer, the term of this patent is extended or adjusted under 35 U.S.C. 154(b) by 0 days.

(21) Appl. No.: 15/265,756

(22) Filed: Sep. 14, 2016

(51) Int. Cl.
*A63H 37/00* (2006.01)
*B05B 7/14* (2006.01)

(52) U.S. Cl.
CPC ..... *A63H 37/00* (2013.01); *B05B 7/14* (2013.01)

(58) Field of Classification Search
CPC .. A63H 37/00; B05B 7/00; B05B 7/14; B05B 9/00
See application file for complete search history.

(56) References Cited

U.S. PATENT DOCUMENTS 825,843 A 7/1906 Kliemandt
1,153,207 A 9/1915 Eisenberg
1,491,809 A 4/1924 Macchia
1,663,679 A 3/1928 Carpenter
3,999,750 A * 12/1976 Perkins ..... A63J 5/02 137/268
5,015,211 A * 5/1991 Reveen ..... A63H 37/00 124/74
5,149,290 A * 9/1992 Reveen ..... A63H 37/00 124/74
5,338,242 A 8/1994 Cheng
5,352,148 A 10/1994 Watkins
5,403,225 A 4/1995 Watkins
5,413,731 A 5/1995 Adler et al.
5,507,680 A 4/1996 Watkins
5,531,628 A 7/1996 Watkins
5,532,618 A 7/1996 Hardee et al.
5,538,454 A 7/1996 Kessler
5,556,319 A 9/1996 Watkins
5,624,295 A 4/1997 Watkins
5,643,042 A 7/1997 Watkins
5,655,325 A 8/1997 Watkins
5,709,584 A 1/1998 Watkins
5,823,850 A 10/1998 Watkins
6,149,495 A * 11/2000 Austin ..... A63J 5/028 222/195
8,469,768 B1 6/2013 Smith
2003/0024956 A1* 2/2003 Crawford ..... A63J 5/025 222/637
2006/0199469 A1 9/2006 Du
(Continued)

*Primary Examiner* — John Ricci
(74) *Attorney, Agent, or Firm* — Kolisch Hartwell, P.C.

(57) ABSTRACT

A swirl confetti blower is designed to create a conical swirl motion that would cause the confetti to blow down around and up/out the spouts. This blower consists of top that has the confetti loading doors, fan housing and fan blade guard, hanging bracket, the main housing body with the confetti snouts and the octagon vent bottom which is the confetti trough and the bottom air relief portion with the conical diffuser. Diversion of air flow is what helps the confetti to flow not only up and out but also out the bottom relief channel. This Vortex or Swirl is created by using a high velocity blower fan. The blower loads from the snouts or the doors on the top of the unit. This unit can be hung from a truss or positioned on a flat surface. This would be for either manual control or an external DMX unit that would be able to be controlled from a lighting console.

20 Claims, 3 Drawing Sheets

(56) References Cited

U.S. PATENT DOCUMENTS

| | | | | |
|---|---|---|---|---|
| 2015/0352460 | A1 | 12/2015 | Holmes | |
| 2015/0359920 | A1* | 12/2015 | Ohtsuka | A01M 9/0007 222/637 |
| 2016/0175731 | A1 | 6/2016 | Holmes | |

* cited by examiner

SWIRL CONFETTI LAUNCHER

FIELD OF THE INVENTION

The present invention relates generally to a system and method for blowing light weight articles into air by using a fan and more particularly it relates to a system and method for blowing confetti into air by a swirl confetti blower.

BACKGROUND OF THE INVENTION

Use of lightweight materials at amusement parks, concerts, and other events like birthday, wedding, Christmas and New Year's Eve, stage shows, rock concerts, conventions, parades, circus acts etc. has long been enthusiastically enjoyed by audiences. These lightweight materials, in general, create an atmosphere of festivities and excitement for partygoers and/or spectators. Common examples of these lightweight materials include confetti, streamers, glitters, plush balls, foam shapes, etc. Confetti is often created from paper or polyvinyl film that is cut into different shapes, styles, and sizes. Confetti can also be made in a variety of different colors and shapes. Streamers are long strips of paper or polyvinyl film that are curled up into rolls. These lightweight materials, when are projected into the air, they scatter and fall creating a pleasing visual effect.

At small events, these lightweight materials can be projected by hand or a handheld projector device. But at larger events, particularly those that are held in wide areas, a specialized projector may be required, which uses a force supplying apparatus such as a gun-powder-explosive system, or compressed air from a compressed gas tanks, or a pressurized canister. Such projectors operate at pressures in the order of 600-800 p.s.i., and the cannons are usually in the order of several feet long, with a wall thickness in the order of ¼ inch and composed of PVC or metal tubing. Accordingly, such systems are expensive, bulky, not environment friendly and are not safe in the hands of non-professional users.

It is apparent now that numerous innovations for confetti launching devices have been provided in the prior art that are adequate for various purposes. Furthermore, even though these innovations may be suitable for the specific purposes to which they address, accordingly, they would not be suitable for the purposes of the present invention as heretofore described. Thus a simple yet capable of blowing confetti by using a blower in a manual or automatic controlled manner is needed. Further an easy to use and safe multiple chamber confetti blowing system having low operation cost and almost no skills and training required operate system is required.

SUMMARY OF THE INVENTION

The present invention discloses about a system and method for blowing light weight articles into air and more particularly it relates to a system and method for blowing confetti into air by a swirl confetti blower.

According to the present invention a swirl confetti blower comprising, a high velocity fan; and a housing having a top portion, a bottom portion and a middle portion, wherein the fan is positioned at the top portion of the housing, the middle portion of the housing has a storage area for storing confetti, one or more spouts projecting outward of the middle portion and the bottom portion having a conical diverter at the centre and provisions for air relief at periphery, such that central air column of the fan hits the bottom portion and the conical diverter thereby causing a swirl effect and releasing back pressure simultaneously, further the outer air column hits the confetti that is in the storage area and is directed to blow out of the confetti spouts.

In another aspect of the present invention a swirl confetti blower comprising, a housing having top portion, bottom portion and middle portion, wherein the top portion has a hanging bracket facilitating attachment of the confetti blower to ceiling, multiple confetti storage chambers, wherein each chamber has a door at top for loading confetti into the chamber and a door at bottom of the chamber for unloading the confetti, the middle portion has a central storage area for storing confetti that are ready to be blown out, one or more confetti spouts projecting outward of the middle portion in upward direction and the bottom portion having a conical diverter at the centre and one or more bottom baffles for air relief at periphery to release back pressure, wherein the confetti stored in the one or more storage chambers at the top portion of the housing can be unloaded into the central storage area at the middle portion of the housing by opening the one or more doors at bottom of the chambers; and a high velocity fan, wherein the fan is mounted at the centre of the top portion of the housing facilitating central air column of the fan to hit the bottom baffle and the conical diverter thereby causing a swirl effect while simultaneously releasing the back pressure, further the outer air column hits the confetti that is in the central storage area and is directed upwards to blow out of the confetti spouts.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Figure 1:
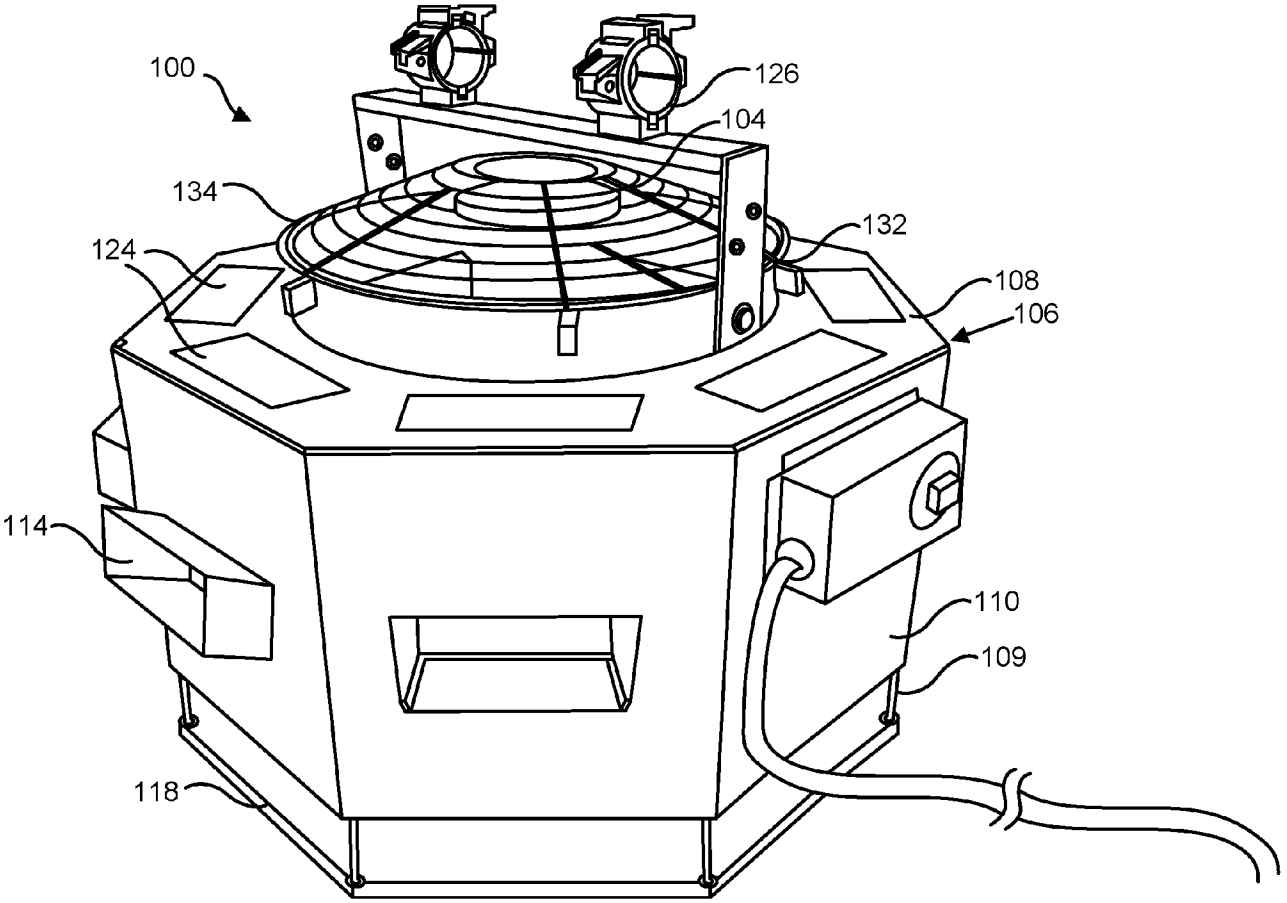
FIG. 1 illustrates a perspective view of an exemplary swirl confetti blowing system in accordance with an embodiment of the present invention.
Figure 2:
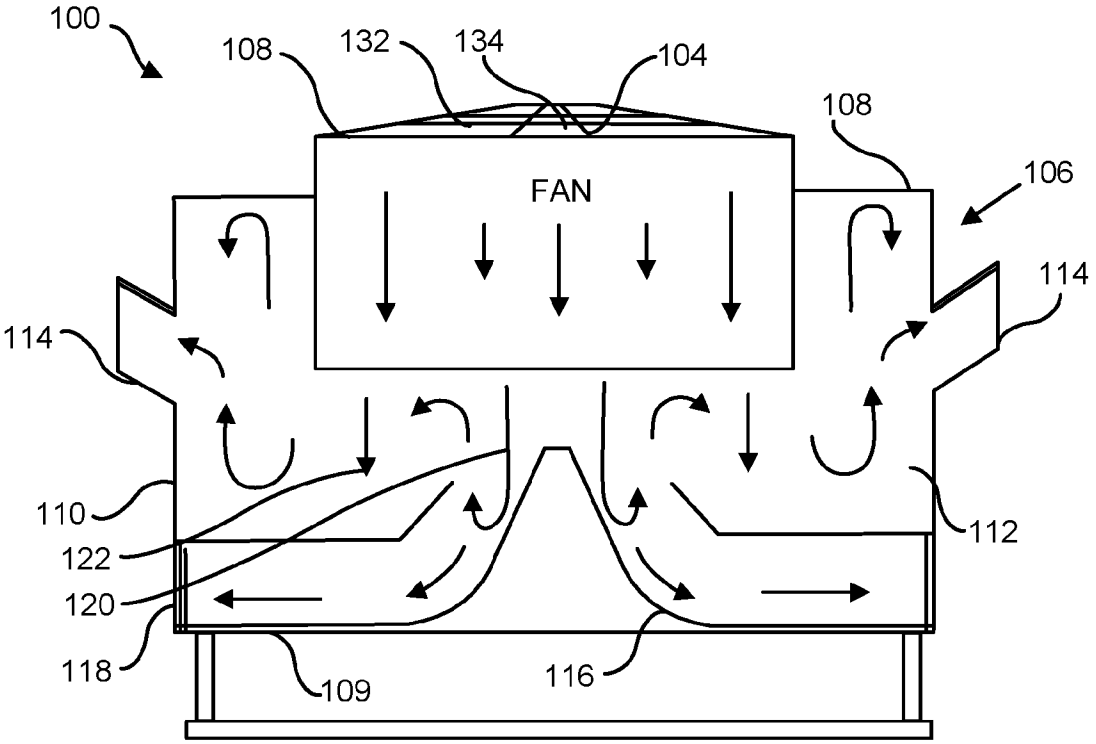
FIG. 2 illustrates a cross sectional view of the swirl confetti blowing system illustrating its functioning in accordance with an embodiment of the present invention.
Figure 3:
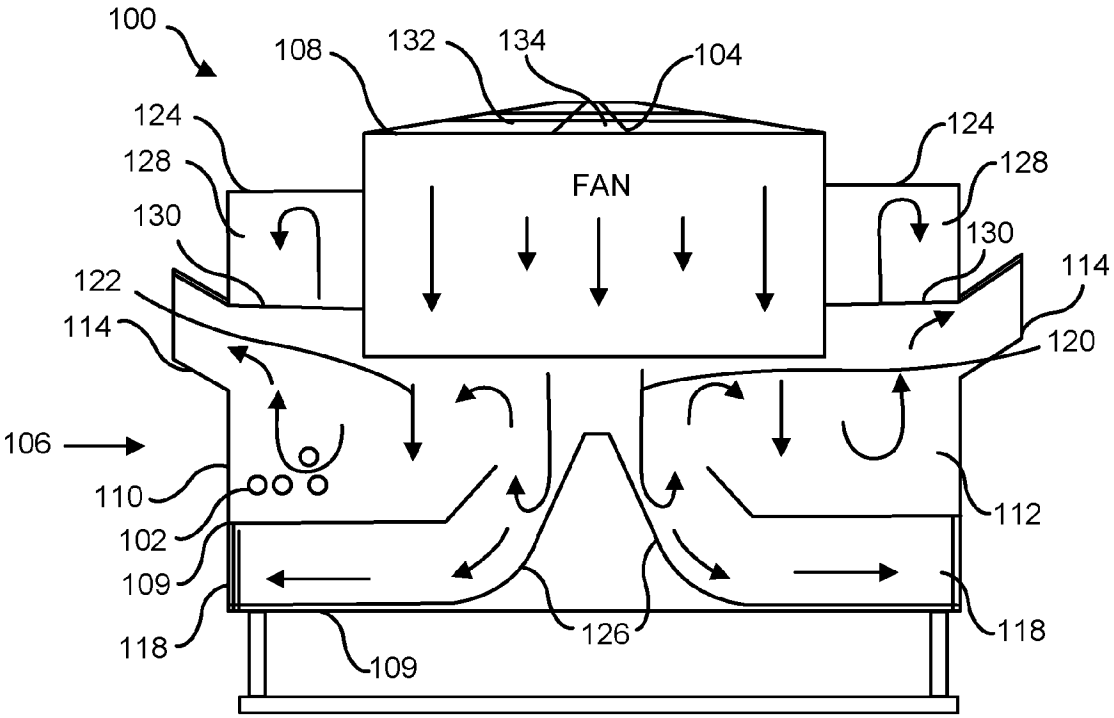
FIG. 3 illustrates a cross sectional view of the multiple chamber swirl confetti blowing system illustrating automatic and selective control of the blowing system in accordance with an embodiment of the present invention.

According to the present invention the device comprises a blowing system 100 for blowing light weight articles 102 into air is referenced in FIGS. 1-3, wherein the blowing system 100 comprising a high velocity fan 104; and a housing 106 having a top portion 108, a bottom portion 109 and a middle portion 110, wherein the fan 104 is positioned at the top portion 108 of the housing 106, the middle portion 110 of the housing 106 has a storage area 112 for storing confetti 102, one or more spouts 114 projecting outward of the middle portion 110 and the bottom portion 109 having a conical diverter 116 at the centre and provisions for air relief 118 at periphery, such that central air column 120 of the fan 104 hits the bottom portion 109 and the conical diverter 116 thereby causing a swirl effect and releasing back pressure simultaneously, further outer air column 122 hits the confetti 102 that is in the storage area 112 and is directed to blow out of the confetti spouts 114.

According to another aspect of the present invention, a swirl confetti blower 100 comprising: a housing 106 having top portion 108, bottom portion 109 and middle portion 110, wherein the top portion 108 has one or more confetti loading doors 122 and a hanging bracket 124 facilitating attachment of the blower 100 to ceiling, the middle portion 110 has a storage area 112 for storing confetti 102, one or more confetti spouts 114 projecting outward of the middle portion 110 in upward direction and the bottom portion 109 having a conical diverter 116 at the centre and one or more bottom baffles 118 for air relief at periphery to release back pressure; and a high velocity fan 104, wherein the fan 104 is mounted at the centre of the top portion 108 of the housing 106 such that central air column of the fan 104 hits the bottom baffle 118 and the conical diverter 116 thereby causing a swirl effect while simultaneously releasing the back pressure, further the outer air column 122 hits the confetti 102 that is in the central storage area 112 and is directed upwards to blow confetti 102 out of the spouts 114.

According to another aspect of the present invention, a swirl confetti blower 100 comprising: a housing having top portion 108, bottom portion 109 and middle portion 110, wherein the top portion 108 has a hanging bracket facilitating attachment of the confetti blower 100 to ceiling, further the top portion 108 has multiple confetti storage chambers 128, wherein each chamber 128 has a door 124 at top for loading confetti 102 into the chamber 128 and a door 130 at bottom of the chamber 128 for unloading the confetti 102, the middle portion 110 has a central storage area 112 for storing confetti 102 that are ready to be blown out, one or more confetti spouts 114 projecting outward of the middle portion 110 in upward direction and the bottom portion 109 having a conical diverter 116 at the centre and one or more bottom baffles 118 for air relief at periphery to release back pressure, wherein the confetti 102 stored in the one or more storage chambers 128 at the top portion 108 of the housing 106 can be unloaded at a time into the central storage area 112 at the middle portion 110 of the housing 106 by opening the one or more doors 130 at bottom of the chambers 128; and a high velocity fan 104, wherein the fan 104 is mounted at the centre of the top portion 108 of the housing 106 facilitating central air column 112 of the fan 104 to hit the bottom baffle 118 and the conical diverter 116 thereby causing a swirl effect while simultaneously releasing the back pressure, further the outer air column 122 hits the confetti 102 that is in the central storage area 112 and is directed upwards to blow out of the confetti spouts 114.

As shown in FIGS. 1-3, a swirl confetti blower 100 consists of three areas, the first part is the top portion 108 that has the confetti loading doors 124, fan housing 132 and fan blade guard 134, hanging bracket 126. The second part is the main housing body 110 with the confetti spouts 114 and the octagon vent bottom 118 which is also referred as the confetti trough 112 and the third part is the bottom air relief portion 112 with the conical diffuser 116. The swirl confetti blower 100 is designed to create a conical swirl motion that would cause the confetti 102 to blow down around and up and out of the six spouts 114. However any number of spouts 114 and of any size can be configured in the blower 100 without departing from the scope and spirit of the invention. The diversion of air flow is what helps the confetti to flow not only up and out but also out the bottom relief channel 118. This vortex or swirl is created by using the high velocity blower fan 104. Wherein the blower 100 loads from the spouts 114 or the doors 124 on the top of the unit 108. The blower 100 can be hung from a truss or positioned on a flat surface. It has a three position switch that has an OFF, High Speed and Low Speed positions. The fan 104 blows downward in a 16 inch column as shown in the FIGS. 2 and 3, however any size of air column can be forced by any capacity fans 104 in the blower 100 without departing from the scope and spirit of the invention. The lower section has a 10 inch octagon shape cut out and is raised up to create a trough 112, however any size and shape of cut out can be configured in the blower without departing from the scope and spirit of the invention. The fans 104 center core is blowing through the center and hits the bottom baffle 118 and conical diverter 116 and causes a swirl effect and a back pressure situation while the outer air column hits the confetti 102 that is in the octagon trough 112 and it is directed upwards to blow out of the confetti spouts 114 that are in the upper body of the machine. This would be for either manual control or an external DMX unit that would be able to be controlled from a lighting console and have the ability to do multiple confetti/color drops for different applications.

In an exemplary embodiment of the invention, the swirl confetti blower 100 can be used for blowing confetti 102 with different color and style in an automatic controlled manner by outfitting the blower 100 with a DMX control unit (not shown). Initially the trough or the central chambers 112 at middle portion 110 of the blower 100 is loaded with the first color or style of confetti 102 and the other six compartments at top portion 108 of the blower 100 will be actuated by one or more DMX channels of the DMX control, that will drop the next preload color or style of confetti 102. The first channel runs the blower fan 104. Channel numbers 2, 3 & 4 control solenoids that keep the spring loaded bottom doors 130 of the chambers at the top portion 108 of the blower 100 is closed. While filling the lower portion of the blower, i.e. the trough or the central chambers 112 at middle portion 110 of the blower 100 either through the spouts 114 or from the top 124 with the first confetti colors/style that is desired, the confetti storage chambers at the top portion 128 of the housing 106 can be loaded by opening up the upper doors 124 while making sure all spring loaded doors 130 at bottom of the storage chambers 128 at the top portion 108 of the housing 106 are securely latched in the closed position, then filling each chambers 128 with the desired color/style of confetti 102. When each of the channels is activated, it will open two opposite doors 130 dropping the confetti 102 into the lower trough 112. However other several combinations of opening the spring loaded doors 130 by the DMX channels can be done without departing from the scope and spirit of the invention. This selection of chambers for desired color/style of confetti can be repeated by choosing the desired channel for opening one or more door of the chambers for the next desired color/style.

In an alternate embodiment of the invention the spring loaded doors at bottom 130 of the storage chambers 128 at the top portion 108 of the housing 106 can be opened manually either by pulling a string hanging from each of the spring loaded bottom doors 130, however other manual arrangement can be used for dropping the confetti 102 stored in the storage chambers 128 at the top portion 108 of the housing 106 into the central chamber 112 without departing from the scope and spirit of the invention for blowing confetti 102 several times and with several color and style options at desired manner and time interval.

In another aspect, the blower 100 has six confetti spouts 114, however any number of spouts 114 can be configured around the housing 106 in the blower 100 without departing from the scope and spirit of the invention.

In another aspect, the blower 100 has a hanging bracket 126 attached to the top portion of the housing 108 so as to facilitate to be hung, further the blower 100 can be positioned on a flat surface.

In another aspect, the conical diverter 116 diverts the air flow in such a direction that helps the confetti 102 to flow not only up and out but also out of the bottom relief channel 118.

In another aspect, the blower 100 loads from the spouts 114 on the middle portion of the housing 110.

In another aspect, the blower 100 has a three position switch that has an OFF, speed 1 and speed 2 positions.

In another aspect, the blower 100 has eight confetti loading doors 124 on the top portion of the housing 108, however any number of confetti loading doors 124 can be configured on the housing 106 without departing from the scope and spirit of the invention.

In another aspect, the fan 104 blows air downward in a 16 inch column, however blowing systems of several sizes and power can be used without departing from the scope and spirit of the invention.

In another aspect, the DMX control unit (not shown) has at least one channel to control the fan 104 speed and one or more channels to control the solenoids that open or close the spring loaded doors 130 at bottom of the storage chambers 128 at the top portion of the housing 108.

In another aspect, the blower 100 has eight confetti storage chambers 128 at the top portion of the housing 108, however any number of confetti storage chambers 128 can be configured on the housing 106 without departing from the scope and spirit of the invention.

One objective of the present invention is to provide a safe and easy to operate confetti blowing system 100.

Another objective is to provide a low operation cost confetti blowing system 100.

Yet another objective is to provide a confetti blowing system 100 that can reuse the light weight articles such as confetti 102 that are once blown can be reused by refilling the used confetti 102 into the system 100.

Yet another objective is to provide a multiple chamber confetti blowing system 100 for blowing the confetti from each chamber (112 and 128) or in several combinations in a controlled manner either manually or using an automatic activation system such as DMX controller.

Yet another objective is to provide a blowing device 100 which requires no skill and training to quickly blow the confetti 102 from the device 100.

Yet another objective is to provide a confetti blowing system 100 which is capable of being hung to ceiling and can be positioned on a flat surface as well.

Yet another objective is to provide a confetti blowing system 100 which is capable of blowing confetti 102 in different speeds and in a controlled manner.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A swirl confetti blower comprising:

a high velocity fan; and a housing having a top portion, a bottom portion and a middle portion, wherein the fan is positioned at the top portion of the housing, the middle portion of the housing has a storage area for storing confetti, one or more spouts projecting outward of the middle portion and the bottom portion having a conical diverter at the center and provisions for air relief at periphery, such that a central air column of the fan hits the bottom portion and the conical diverter thereby causing a swirl effect and releasing back pressure simultaneously, and an outer air column hits the confetti that is in the storage area and is directed to blow out of the confetti spouts.

2. The blower of claim 1, wherein the blower has six confetti spouts.

3. The blower of claim 1, wherein the blower has a hanging bracket attached to the top portion of the housing so as to facilitate to be hung, further the blower can be positioned on a flat surface.

4. The blower of claim 1, wherein the conical diverter diverts the air flow in such a direction that helps the confetti to flow not only up and out but also out of a bottom relief channel formed in the bottom portion.

5. The blower of claim 1, wherein the blower loads from the spouts on the middle portion of the housing.

6. The blower of claim 1, wherein the blower has a three position switch that has an OFF, high speed and low speed positions.

7. A swirl confetti blower comprising:

a housing having top portion, bottom portion and middle portion, wherein the top portion has one or more confetti loading doors and a hanging bracket facilitating attachment of the blower to ceiling, the middle portion has a storage area for storing confetti, one or more confetti spouts projecting outward of the middle portion in upward direction and the bottom portion having a conical diverter at the center and one or more bottom baffles for air relief at periphery to release back pressure; and a high velocity fan, wherein the fan is mounted at the center of the top portion of the housing such that a central air column of the fan hits the bottom baffle and the conical diverter thereby causing a swirl effect while simultaneously releasing the back pressure, and an outer air column hits the confetti that is in the central storage area and is directed upwards to blow out of the confetti spouts.

8. The blower of claim 7, wherein the blower has eight confetti loading doors on the top portion of the housing.

9. The blower of claim 7, wherein the fan blows air downward in a 16 inch column.

10. The blower of claim 7, wherein the blower has six confetti spouts.

11. The blower of claim 7, wherein the blower can be hung from a truss by the hanging bracket or positioned on a flat surface.

12. The blower of claim 7, wherein the conical diverter diverts the air flow in such a direction that helps the confetti to flow not only up and out but also out of a bottom relief channel formed in the bottom portion.

13. The blower of claim 7, wherein the blower loads from the spouts or the doors on the top portion of the housing.

14. The blower of claim 7, wherein the blower has a three position switch that has an OFF, high speed and low speed positions.

15. A swirl confetti blower comprising:

a housing having top portion, bottom portion and middle portion, wherein the top portion has a hanging bracket facilitating attachment of the confetti blower to ceiling, multiple confetti storage chambers, wherein each chamber has a door at top for loading confetti into the chamber and a door at bottom of the chamber for unloading the confetti, the middle portion has a central storage area for storing confetti that are ready to be blown out, one or more confetti spouts projecting outward of the middle portion in upward direction and the bottom portion having a conical diverter at the center and one or more bottom baffles for air relief at periphery to release back pressure, wherein the confetti stored in the one or more storage chambers at the top portion of the housing can be unloaded at a time into the central storage area at the middle portion of the housing by opening the one or more doors at bottom of the chambers; and a high velocity fan, wherein the fan is mounted at the center of the top portion of the housing, facilitating a central air column of the fan to hit the bottom baffle and the conical diverter, thereby causing a swirl effect while simultaneously releasing the back pressure, and an outer air column to hit the confetti that is in the central storage area and is directed upwards to blow out of the confetti spouts.

16. The blower of claim 15, wherein the doors at bottom of the storage chambers at the top portion of the housing are spring loaded doors, that are connected to solenoid and can be actuated automatically by a DMX control unit.

17. The DMX control unit of claim 16, wherein the DMX control unit has at least one channel to control the fan speed and one or more channels to control the solenoids that open or close the spring loaded doors at bottom of the storage chambers at the top portion of the housing.

18. The blower of claim 15, wherein the blower has eight confetti storage chambers at the top portion of the housing.

19. The blower of claim 15, wherein the blower has six confetti spouts.

20. The blower of claim 15, wherein the conical diverter diverts the air flow in such a direction that helps the confetti to flow not only up and out but also out of a bottom relief channel formed in the bottom portion.

* * * * *